US007310981B2

(12) United States Patent
Kurz et al.

(10) Patent No.: US 7,310,981 B2
(45) **Date of Patent: *Dec. 25, 2007**

(54) METHOD FOR REGULATING THE TEMPERATURE OF STRIP METAL

(75) Inventors: Matthias Kurz, Erlangen (DE); Michael Metzger, Erlangen (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

This patent is subject to a terminal disclaimer.

(21) Appl. No.: 10/545,781

(22) PCT Filed: Feb. 13, 2004

(86) PCT No.: PCT/EP2004/001366

§ 371 (c)(1),
(2), (4) Date: Aug. 16, 2005

(87) PCT Pub. No.: WO2004/076086

PCT Pub. Date: Sep. 10, 2004

(65) Prior Publication Data

US 2006/0156773 A1 Jul. 20, 2006

(30) Foreign Application Priority Data

Feb. 25, 2003 (DE) ..... 103 08 222
May 14, 2003 (DE) ..... 103 21 791

(51) Int. Cl.
*B21B 37/74* (2006.01)
*B21B 27/06* (2006.01)

(52) U.S. Cl. ..... 72/8.5; 72/12.2; 72/201; 72/342.2; 72/342.6; 700/30; 700/108; 700/148; 148/511; 266/87

(58) Field of Classification Search ..... 700/108, 700/30, 148, 149, 150, 153; 72/8.5, 12.2, 72/16.5, 18.3, 19.1, 200, 201, 342.2, 342.6; 148/511; 266/87
See application file for complete search history.

(56) References Cited

U.S. PATENT DOCUMENTS

| | | | | |
|---|---|---|---|---|
| 5,126,947 | A | 6/1992 | Koyama | |
| 5,691,921 | A * | 11/1997 | Berlin | 702/99 |
| 6,185,970 | B1 | 2/2001 | Latzel | |
| 6,220,067 | B1 | 4/2001 | Sano | |
| 6,225,609 | B1 * | 5/2001 | Imanari et al. | 219/494 |
| 6,430,461 | B1 * | 8/2002 | Andorfer et al. | 700/148 |
| 6,866,729 | B2 * | 3/2005 | Gramckow et al. | 148/511 |
| 7,085,619 | B2 * | 8/2006 | Broese et al. | 700/164 |

FOREIGN PATENT DOCUMENTS

| | | | |
|---|---|---|---|
| DE | 197 17 615 | A1 | 10/1998 |
| EP | 1 014 239 | A1 | 6/2000 |
| JP | 58221606 | A * | 12/1983 |
| JP | 09 285810 | A | 11/1997 |

* cited by examiner

*Primary Examiner*—Dmitry Suhol

(57) ABSTRACT

The invention relates to a method for controlling and regulating the temperature of a metal strip in a finishing train of a hot rolling mill. A target function is formed by comparing a desired temperature gradient with an actual temperature gradient. The target function measures deviations from desired indications positioned in various places on the finishing train. The speed of the strip and the flow of the cooling agent are adjusted by predicting with the aid of a method of non-linear optimization with auxiliary conditions and are regulated and controlled online by solving a quadratic optimization problem with linear auxiliary conditions, preferably with the aid of an active set strategy.

11 Claims, 5 Drawing Sheets

METHOD FOR REGULATING THE TEMPERATURE OF STRIP METAL

CROSS REFERENCE TO RELATED APPLICATIONS

This application claims priority to the German applications No. 10308222.0, filed Feb. 25, 2003 and No. 10321791.6, filed May 14, 2003, and to the International Application No. PCT/EP2004/001366, filed Feb. 13, 2004 which are incorporated by reference herein in their entirety.

FIELD OF INVENTION

The invention relates to a method for controlling and regulating the temperature of a metal strip, e.g. of steel or aluminum, in a finishing train for rolling a metal hot strip.

BACKGROUND OF INVENTION

U.S. Pat. No. 6,220,067 B1 describes a method which regulates the temperature of a metal strip at the output end of a mill train, i.e. the final rolling temperature. A method of this type cannot adequately selectively influence phase changes, which especially in dual-phase rolling are of significance for the material properties of the rolled metal strip, in the steel in the mill train. A comparable method, which serves for calculating a pass schedule, is described in EP 1 014 239 A1.

SUMMARY OF INVENTION

The material properties and the structure of a rolled metal strip are determined by chemical composition and process parameters, especially during the rolling process, such as e.g. load distribution and temperature management. Final control elements for the rolling temperature, in particular the final rolling temperature, are, depending on the type of plant and mode of operation, generally speed of the strip and inter-stand cooling.

An object of the invention is to improve the control or regulation of the temperature of a metal strip, especially in a finishing train, such that disadvantages known from the prior art are avoided and in particular that the control or regulation of the aforementioned final control elements is improved.

The object according to the invention is achieved in a method for controlling and/or regulating the temperature of a metal strip, especially in a finishing train, whereby, in order to determine adjustment signals, a desired temperature gradient is compared with an actual temperature gradient, whereby a temperature gradient for individual strip points on the metal strip is determined and whereby, taking into account auxiliary conditions, at least one target function is formed for final control elements of the plant in the finishing train.

In determining the temperature gradient for individual points on the strip, the path and preferably also properties such as the temperature of individual points on the strip are advantageously traced. In this way, the precision of the control and regulation is significantly improved.

Advantageously, the target function is solved by solving an optimization problem. Here, technical constraints such as in particular adjustment limitations of the final control elements are taken into account in an extremely favorable manner whereby, in particular, as much scope as possible is provided for changing the final control elements and whereby the computing time needed for controlling and regulating is kept very low.

Advantageously, a desired temperature at the end of the finishing train is predetermined. Alternatively, or in addition, at least one desired temperature in the finishing train is predetermined. Control and regulation are in this way substantially improved with regard to the material properties of the metal strip and with regard to its structural composition.

Advantageously, the actual temperature gradient of the metal strip is determined with the aid of at least one model. In this way, improved control or regulation of the temperature of the metal strip is enabled, even if the actual temperature of the strip cannot be measured at points, especially in the finishing train, relevant for control or regulation.

Advantageously, the model is adapted online. In this way, any plant drift that exists can be taken into account and realistic results, especially for the next metal strips to be rolled, can be determined.

Advantageously, adjustment signals are determined for the flow of the cooling agent.

Advantageously, actuating signals are determined for the flow of the material.

Advantageously, in order to solve the target function, an optimization problem with linear auxiliary conditions is solved online, i.e. in particular in real time. Adjustment limitations are established here, in particular in the form of equality or inequality auxiliary conditions. Solution of the optimization advantageously returns here the values of the adjustment variables for a next controller cycle. This provides regulation that is structured clearly, uniformly and independently of the plant configuration and that works reliably and fast.

Advantageously, a quadratic optimization problem is solved. The optimization problem can in this way be solved particularly fast.

Advantageously, the optimization problem is solved with the aid of an active set strategy. The optimization problem can in this way be solved particularly effectively in real time.

Advantageously, an online-capable pass schedule algorithm is calculated in advance by means of non-linear optimizations with auxiliary conditions. The length of time for calculating the pass schedule is in this way kept extremely small. The calculation of the pass schedule returns set-up values which are in particular optimally matched to the controller operating online. In this way the controller has sufficient scope to influence the temperature of the strip.

The inventive method for controlling and for regulating the temperature of a metal strip is in particular also suitable for rolling strips with a thickness wedge, as is used for example in semi-continuous rolling with finished strip thicknesses below 1 mm. When rolling strips with a thickness wedge, additional auxiliary conditions with regard to the final control elements become active.

Further embodiments are included in the remaining independent and dependent claims. The advantages described for the method according to the invention apply analogously.

BRIEF DESCRIPTION OF THE DRAWINGS

Further advantages and details will emerge from the description below of several exemplary embodiments of the invention and from the associated drawings in which by way of example.

DETAILED DESCRIPTION OF INVENTION

Figure 1:
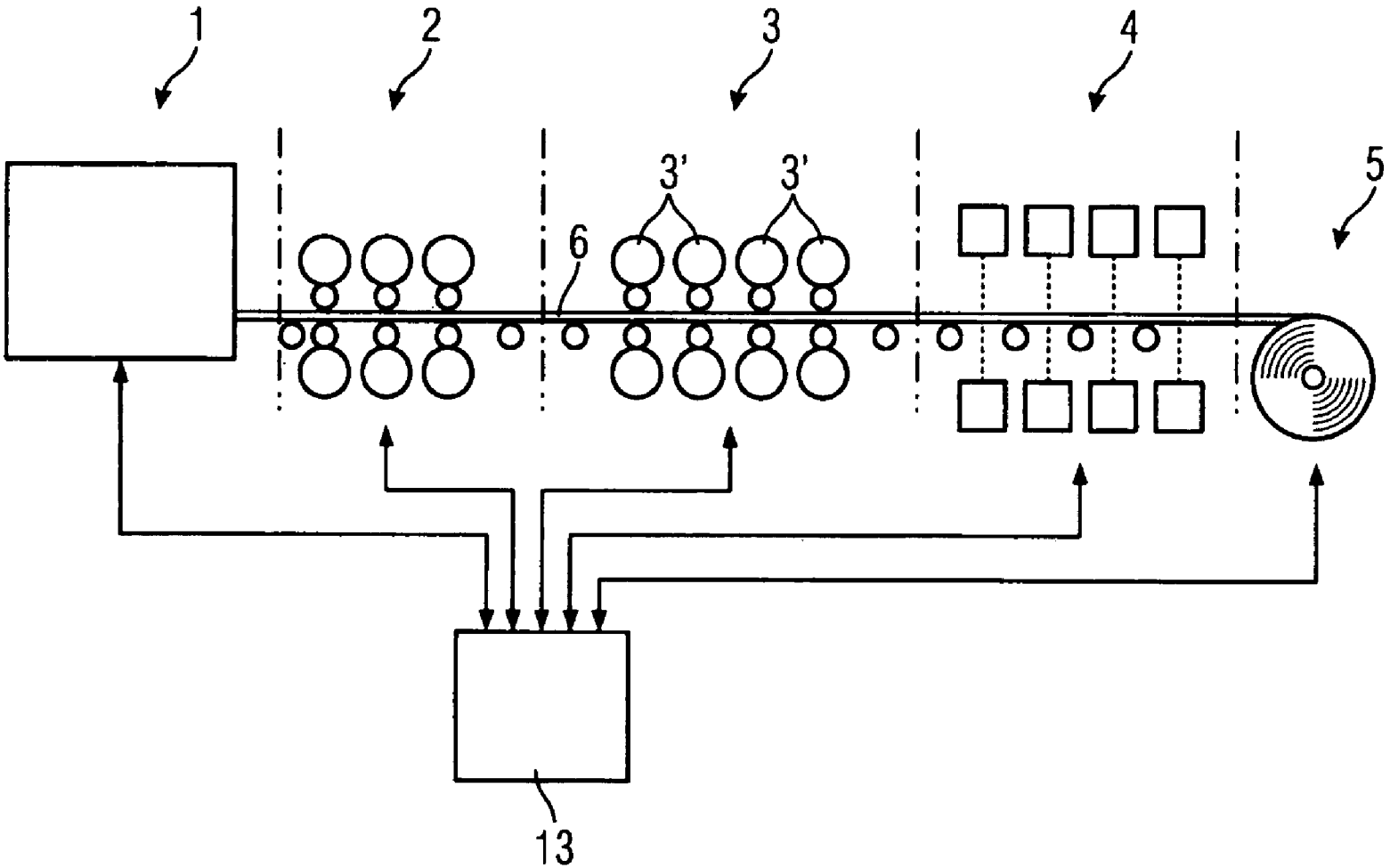
FIG. 1 shows the basic structure of a rolling mill.

FIG. 1 shows a plant for the production of metal strip 6, comprising a roughing train 2, a finishing train 3 and a cooling stretch 4. Plants of this type are typical for the steel and metal industry. A reeling device 5 is arranged downstream of the cooling stretch 4. The metal strip 6 which is rolled preferably hot in the trains 2 and 3 and cooled in the cooling stretch 4 is reeled in by said reeling device. A strip source 1 is arranged upstream of the trains 2 and 3, which strip source is fashioned for example as a furnace in which metal slabs are heated or for example as a continuous casting plant in which metal strip 6 is produced. The metal strip 6 consists for example of aluminum or steel.

The plant and in particular the trains 2, 3 and the cooling stretch 4 and the at least one reeling device 5 are controlled by means of a control method which is executed by a computing device 13. To this end, the computing device 13 has control engineering links to the individual components 1 to 5 of the plant for steel or aluminum production. The computing device 13 is programmed with a control program fashioned as a computer program, on the basis of which it executes the method according to the invention for controlling and regulating the temperature of the metal strip 6.

In accordance with FIG. 1, the metal strip or slab 6 leaves the strip source 1 and is then first rolled in the roughing train 2 to an input thickness for the finishing train 3. Inside the finishing train, the strip 6 is then rolled by means of the rolling stands 3' to its final thickness. The subsequent cooling stretch 4 cools the strip 6 to a predetermined reeling temperature.

In order to ensure desired mechanical properties in the strip 6, a suitable temperature gradient has to be observed for the finishing train 3 and the cooling stretch 4. Since virtually no widening of the rolled strip 6 occurs during the rolling process, the length of the strip and—provided the flow of material remains constant—the speed of the strip increase through the rolling process.

Figure 2:
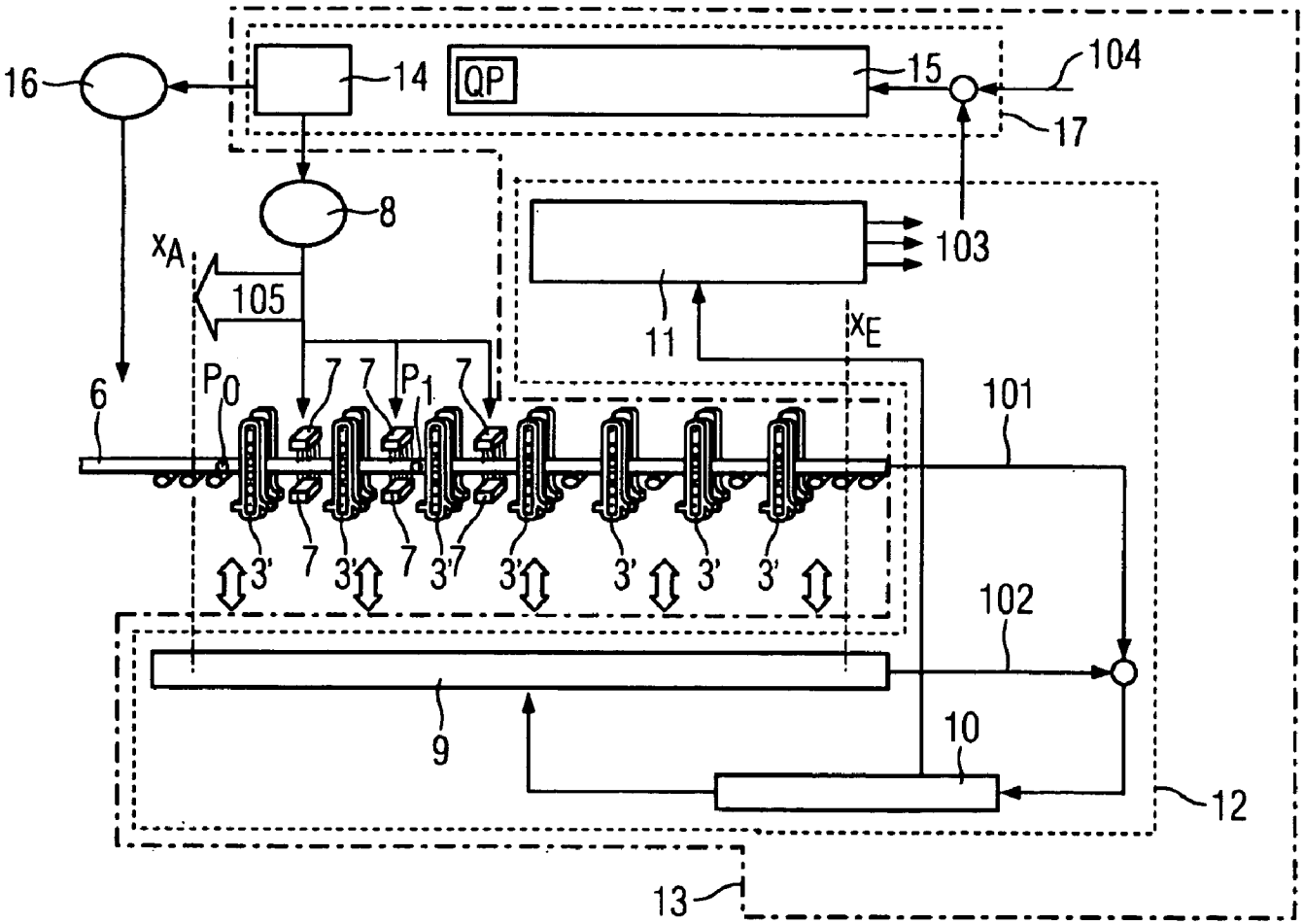
FIG. 2 shows the schematic arrangement of a model-predictive control for the finishing train.

FIG. 2 presents in detail the finishing train 3 with its rolling stands 3' and illustrates the model-predictive regulation of the finishing train 3 according to the invention.

Inside the finishing train 3, the times of contact of the hot metal strip 6 with the relatively cold working rolls of the rolling stands 3' and the inter-stand cooling devices 7 are the most important factors influencing the temperature of the metal strip 6. The final control elements for controlling and regulating the temperature of the strip in the finishing train are accordingly the flow of the material 16 and the flow of the cooling agent 8. In FIG. 2, two strip points $P_0$, $P_1$ on the metal strip 6 are highlighted by way of example in order to simplify the explanation of the exemplary embodiment.

The finishing train 3 is delimited by its start $x_A$ and its end $x_E$. The plant dynamics in the finishing train 3 are characterized in terms of temperature by relatively long idle times 105. Thus, for example, the influence of a change in the flow of the cooling agent 8 on the temperature at the end $x_A$ of the finishing train 3 can be observed only when the first strip point $P_0$, $P_1$ which was influenced by this change leaves the last rolling stand 3'. That is one reason why regulation of the strip temperature 17 according to the invention is fashioned as model-predictive regulation.

The computing device 13 for controlling the steel industry plant and in particular for controlling the finishing train 3 has a strip temperature model 12 and a strip temperature regulation 17. The strip temperature model 12 and the strip temperature regulation 17 operate preferably cyclically in regulating steps.

The strip temperature regulation 17 has a regulating device 14 which controls and regulates the flow of the cooling agent 14 of the inter-stand cooling devices 7 and the flow of the material 16 of the metal strip 6, i.e. in particular the speed v of said metal strip. Upstream of the regulating device 14 is a linearized model 15 which is processed with the aid of quadratic programming.

The module 12 for determining the strip temperature online has an online monitor 9 for ascertaining the current strip temperature, a module for online adaptation 10 and preferably a module for predicting 11 the temperature $T^j_{k=0,\,1}$ of selected points $P_0$, $P_1$ on the strip.

The online monitor 9 uses a model for determining the current strip temperature and preferably the phase status of the metal strip 6 inside the finishing train 3. The module 12 for determining the strip temperature online therefore has a strip temperature model, not shown in detail in the drawings. The strip temperature model makes it possible for example to predict the final temperature of strip points $P_0$, $P_1$, i.e. in particular the temperature of the strip points P0, P1, at the position $x_E$. Taking this as a starting point, a linearized model 15 is set up which determines the strip temperature for a working point of the finishing train 3 for a given change in the flow of the cooling agent 8 and/or a given change in the flow of the material 16.

By minimizing the quadratic deviation of the output of the linearized model 15, new correction values are determined for flow of the cooling agent 8 and flow of the material 16. Given desired values for interim strip temperatures preferably inside the finishing train or given desired values for the final temperature of the strip 6 in the finishing train 3 are taken into account in determining these correction values. Through linearization of the strip temperature model, a quadratic programming problem is produced which can be solved sufficiently fast to allow online control of the strip temperature.

The task of the online monitor 9 is to determine the current status, i.e. in particular all the interim temperatures needed for control and regulation, of the metal strip 6 in the finishing train 3. The data 102 available at the output of the online monitor 9 preferably also contains real-time model corrections.

Strip data 101 actually measured in the finishing train, and in particular temperatures, will possibly not always be available and generally only at a few defined points, sometimes only at the points $x_A$ and $x_E$. Online adaptation 10 uses data 102 computed by the online monitor 9, in particular temperatures determined by the online monitor, as well as preferably measured temperatures 101.

With the aid of the online adaptation 10, correction factors are determined which are used in particular for correcting model errors in the online monitor 9. Here, temperatures actually measured 101 are preferably compared with calculated temperatures 102. The online adaptation 10 is linked both to the online monitor 9 and to the module 11 for predicting the temperature of selected points on the strip.

Data originating from the output end of the online adaptation 10 is preferably available at the input end of the module 1 for predicting the strip temperature. The module 11 can process further data determined by the online monitor 9. The strip temperature calculated by the module 11 is passed on to the strip temperature regulation 17. The module 11 for predicting the strip temperature also uses the strip temperature model of the module 12 for determining the strip temperature online.

Input variables of the strip temperature regulation 17 and of the linearized model 15 are the actual temperature gradient determined by the strip temperature model and a predetermined desired temperature gradient. The desired temperature gradient is predetermined depending on the plant type, the operating mode, the respective job and the desired properties of the metal strip 6.

The strip temperature regulation 17 uses input data 103 calculated by the strip temperature model 12. Here, control specifications can be used particularly flexibly since the online monitor 9 can determine any interim temperature of the strip 6 inside the finishing train 3, even if no appropriate measured values are available.

Figure 3:
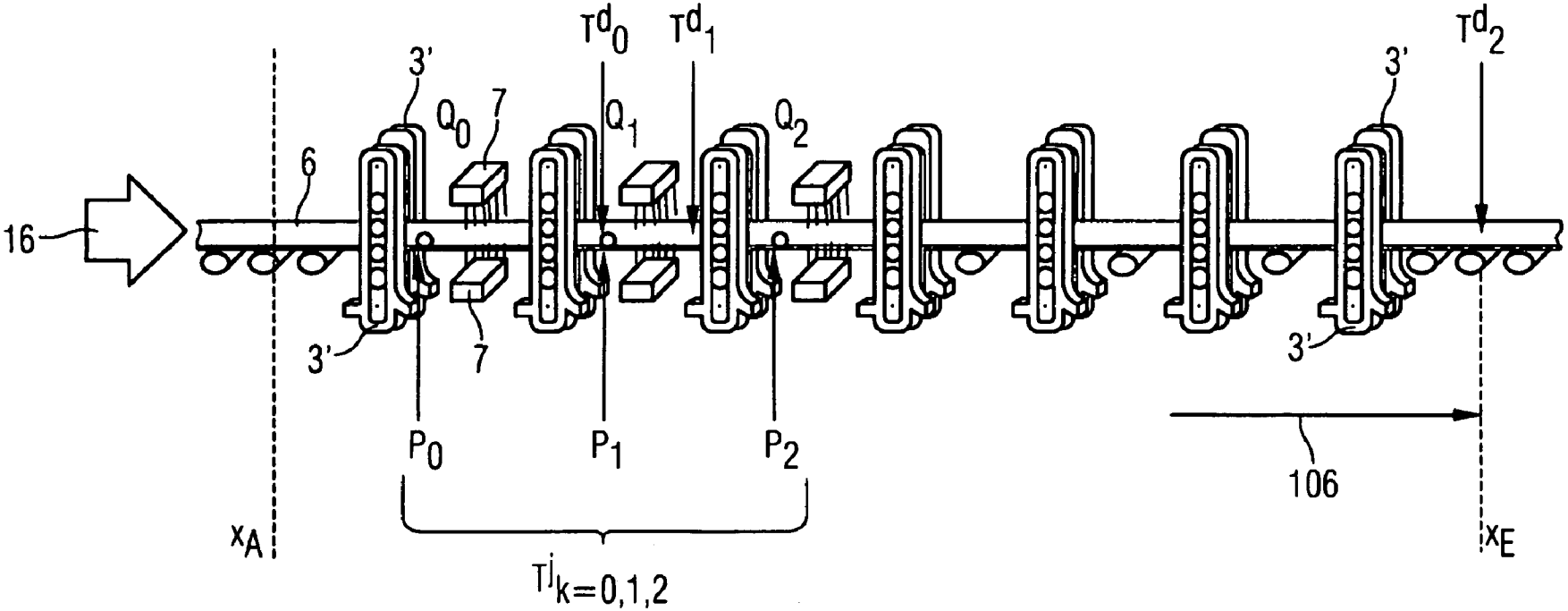
FIG. 3 shows a schematic representation relating to the model-predictive control.

FIG. 3 illustrates schematically problems relevant to model-predictive regulation, such as arise, for example, when metal in the ferrite-phase status range is to be rolled. Besides the desired temperature indication $T^d_2$ at the end $x_E$ of the finishing train 3, further desired temperature values $T^d_0$, $T^d_1$ inside the finishing train 3 are preferably used. If, for example, the rolling operations of the first two rolling stands 3' of the finishing train 3 are to occur in the austenite range, but the remaining rolling operations, i.e. the rolling operations of the downstream rolling stands 3', in the ferrite range, at least three desired temperatures $T^d_0$, $T^d_1$, $T^d_2$, as shown in FIG. 3, are needed.

The first desired temperature $T^d_0$ after the second rolling stand is to ensure that the temperature of the rolling operations in the first two rolling stands lies above the transition temperature between the phase status ranges. The second desired temperature value $T^d_1$ is to ensure the phase transition before the third rolling stand of the finishing train 3. If possible, a final temperature $T^d_2$ at the end $x_E$ of the finishing train 3 should also to be met.

The predicted temperatures needed $T^J_{k=0,1,2}$ are provided by the module 11 for predicting the strip temperature with the aid of a model preferably for multiple points $P_0$, $P_1$, $P_2$, on the strip. The strip temperature regulation 17 can also respond to short-term temperature fluctuations that are caused, for example, by the furnace automatic control. However, this preferably takes place as a result of a change in the flow of the cooling agent 8 and not by a change in the strip speed v or in the flow of the material 16. Short-term temperature fluctuations may, for example, cause local unscheduled irregularities or folds in the metal strip 6.

Long-term temperature fluctuations, which may be caused, for example, by a rolling operation preceding the finishing train 3 and not shown in detail in the drawings, are preferably compensated for by acceleration a of the metal strip 6, i.e. by a change in the flow of the material 16. The prediction horizon 106 is adapted accordingly.

In order to solve the problem shown in FIG. 3, it is preferably solved as a minimization problem with the aid of the linearized model 15. To this end, the control variables corresponding to the flow of the material 16 and the flow of the cooling agent 8 are preferably changed such that they minimize the weighted quadratic error of the predicted temperatures $T^J_{k=0,1,2}$ for the strip points $P_0$, $P_1$, $P_2$ with reference to the desired temperatures $T^d_{k=0,1,2}$ (see equation I). Thus, at the individual valves 7, a coolant flow $Q_0$, $Q_1$ and $Q_2$, jointly referred to as 8, is effected which lies as far as possible from the technical limits of the inter-stand cooling devices 7, which are preferably fashioned as coolant valves or water valves 7. In this way, the maximum possible tolerance is achieved at the inter-stand cooling devices 7 so as later, i.e. in subsequent regulating steps, to be able to respond to short-term temperature fluctuations.

The following adjustment limitations of the inter-stand cooling devices 7 must be taken into consideration: the coolant flow $Q_0$, $Q_1$, $Q_2$ of a valve 7 can be changed only with a speed which matches the dynamics of the respective valve 7 and must not lie outside technically determined minimum $Q^{max}_i$ and maximum $Q^{min}_i$ values. The flow of the material 16 must also lie within technical threshold values which are determined in particular by a maximum and a minimum speed of the metal strip upon leaving the finishing train 3. As far as the flow of the material is concerned, a lower and an upper limit on the acceleration a of the metal strip 6 must also be observed.

A predicted temperature $T^j_k$ for a given flow of the cooling agent 8 and flow of the material 16 and for a given adaptation coefficient for the regulating step concerned is calculated by the module 12 with the aid of the strip temperature model. The adaptation coefficient is preferably frozen for further predictions. In order to calculate the adjustment variables for control for the next control steps, the current flow of the cooling agent 8 and the current flow of the material 16 are set as a working point. The new predicted temperature $\tilde{T}^j_k$ can then be expressed as $T^j_k+\Delta T^j_k$, the following applying:

$$\Delta T^j_k = \Delta T^j_k\left(\Delta u^j_{i_j}, \Delta u^j_{i_{j+1}}, \ldots \Delta u^j_{j_{kj}}, \Delta a, \Delta s\right) \tag{I}$$

Figure 5:
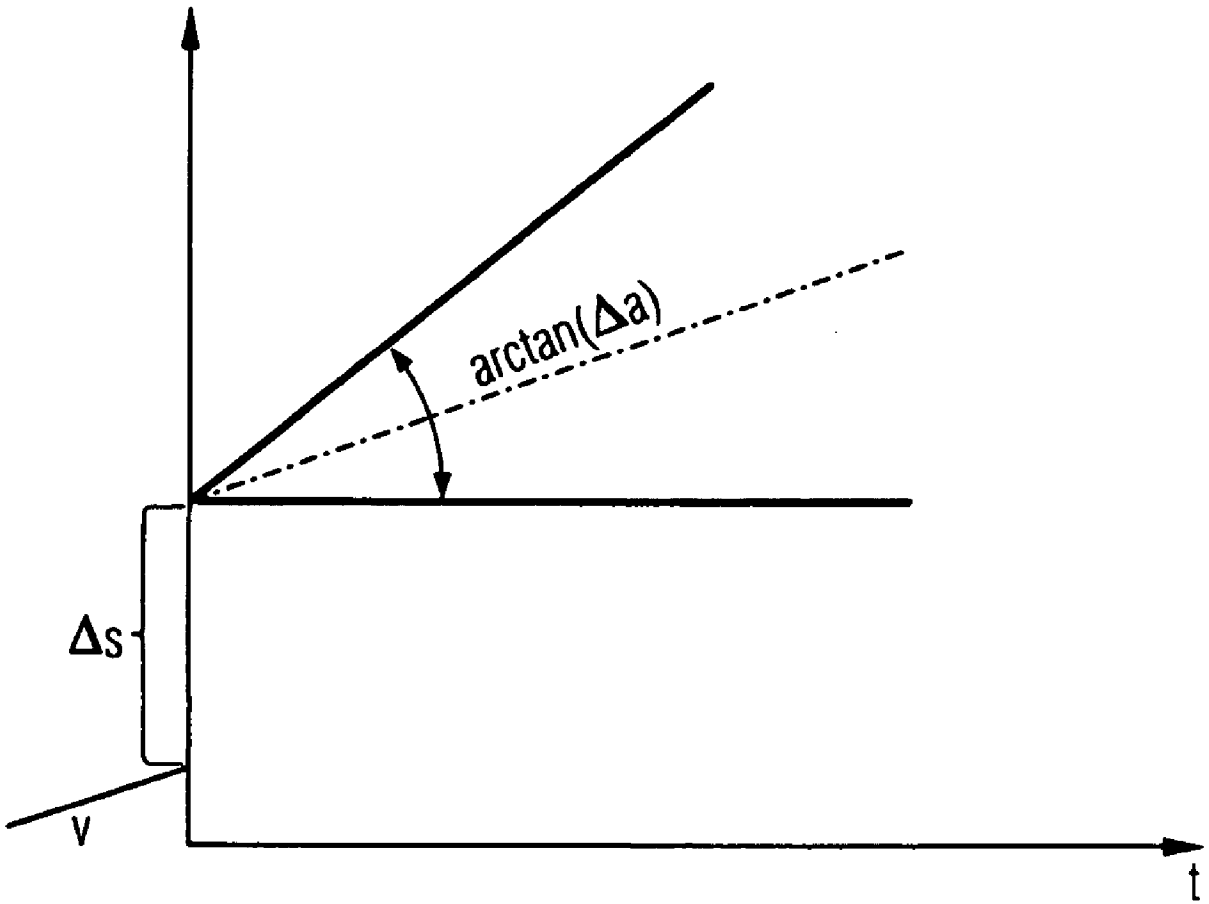
FIG. 5 shows the adjustment or prediction horizon for the flow of the material.

Finally, the target function reproduced below in the variables $\Delta u^j_i$, $\Delta a$ and $\Delta s$, more details of which will be given in connection with FIGS. 5 and 6, is preferably solved, taking into account the adjustment limitations specified previously:

$$\sum_{j=0}^{J-1}\sum_{k=0}^{K-1}\frac{w^j_k}{2}|T^j_k+\Delta T^j_k-T^d_k|^2+\frac{\delta}{2}\sum_{j=0}^{J-1}\sum_{i=i_j}^{i_{k-1,j}}\left|Q^{act}_i+\Delta u^j_i-\frac{Q^{max}_i+Q^{min}_i}{2}\right|^2\frac{\alpha}{2}\sum_{j=0}^{J-1}\sum_{i=i_j}^{i_{K-1,j}}\left|\frac{\Delta u^j_i}{\Delta t}\right|^2+\frac{\beta}{2}\left|\frac{\Delta a}{\Delta t}\right|^2+\frac{\gamma}{2}\left|\frac{\Delta s}{\Delta t}\right|^2 \tag{II}$$

As FIG. 3 shows, the strip temperature is predicted into the future until such time as a point on the strip $P_0$ reaches the last desired temperature value $T^d_2$. As a rule, this lies at the end $x_E$ of the finishing train 3, where a pyrometer, not shown in detail in the drawings, preferably measures the actual temperature of the metal strip 6. The model-predictive prediction is carried out constantly for individual regulating steps $\Delta t$.

Figure 4:
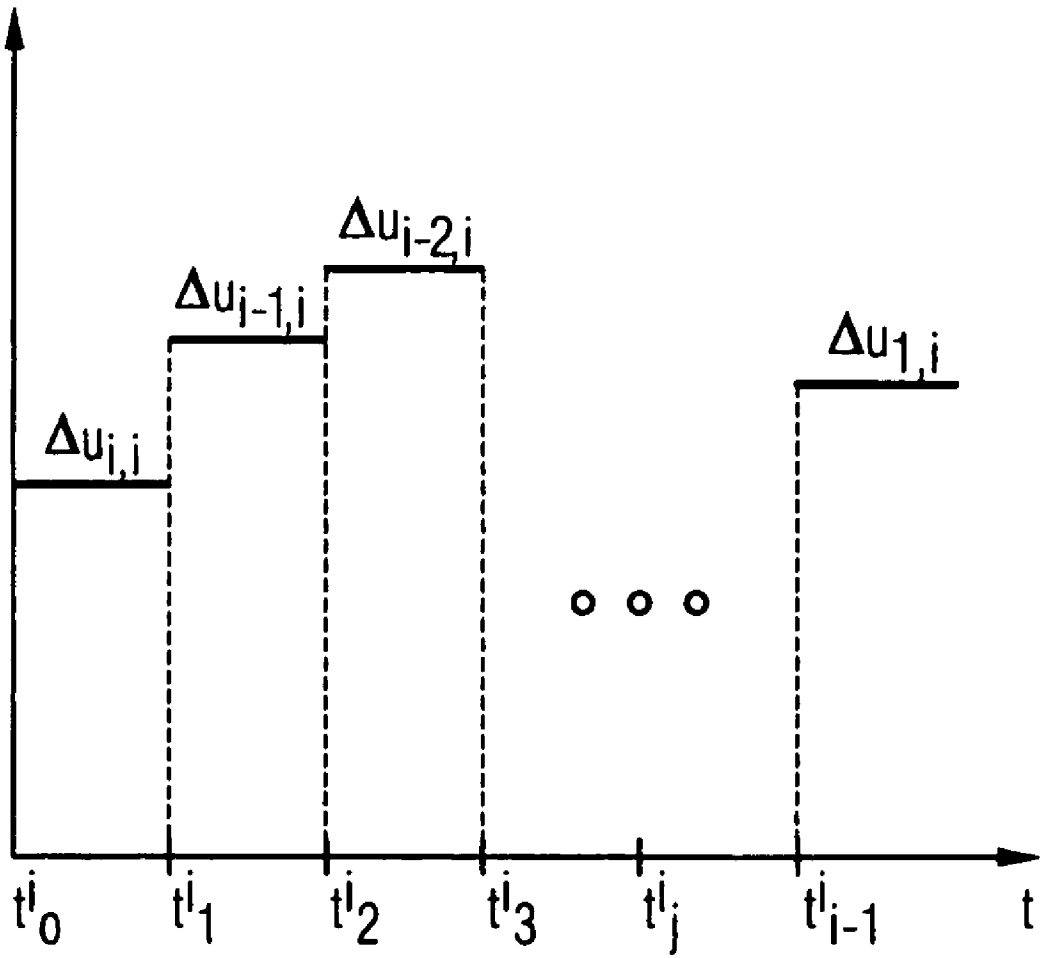
FIG. 4 shows the adjustment or prediction horizon for the flow of the cooling agent.

FIGS. 4 and 5 illustrate the different adjustment horizon for the flow of the cooling agent (see FIG. 4) and for the flow of the material (see FIG. 5). In both Figures, the abscissa represents a time axis.

The flow of the material 16 is preferably influenced by the strip speed v, the adjustment horizon preferably being restricted to a single regulating step. Offset $\Delta s$ and change in acceleration $\Delta a$ are then preferably assumed to be constant (see FIG. 5). Short-term temperature fluctuations, by contrast, are preferably influenced by the flow of the cooling agent $Q_j$. For this, temperature prediction values are preferably used for strip points $P_j$ which, viewed in the direction of flow of the material, lie upstream of the corresponding inter-stand cooling device 7, so that the strip points $P_j$ do not reach the corresponding inter-stand cooling device until the idle time 105 of the corresponding valve 7 plus the computing time have expired.

Although the minimization (II) is carried out, taking into consideration all future coolant flow corrections $\Delta u_i^j$ (see FIG. 4) until the end of the setting horizon, the coolant flow $Q^{act}_{ij}$ is updated only with the aid of the first correction $\Delta u_{i_j}^j$. In order to reduce possible oscillations, the updated values for $\Delta u_{i_j}^j \Delta a$ and $\Delta s$ are where applicable multiplied with a relaxation factor $0<\chi\leqq 1$.

Minimizing the equation (II) taking into account the corresponding adjustment limitations, especially those mentioned previously, means solving a non-linear programming problem which is as a rule extremely computation-intensive and which, in order to be online-capable, has to be accelerated. Regulating steps $\Delta t$ can, according to the invention, be carried out, for example, every 200 milliseconds.

In order to achieve an acceleration, the procedure followed is preferably analogous to the Gauss-Newton method and linearizes the predicted temperature change about the working point:

$$\Delta T_k^j \approx \sum_{i=i_j}^{i_{kj}} S_{ki}^j \Delta u_i^j + \tilde{S}_k^j \Delta a + \bar{S}_k^j \Delta s \tag{III}$$

The sensitivities $S_{ki}^j$, $\tilde{S}_k^j$ and $\bar{S}_k^j$ are approximated by finite differences as follows:

$$S_{k,ij}^j = \frac{T_k^j|_{Q_{ij}^{act}+\Delta} - T_k^j|_{Q_{ij}^{act}}}{\Delta} \tag{IV}$$

$$\tilde{S}_k^j = \frac{T_k^0|_{a^{act}+\Delta} - T_k^0|_{a^{act}}}{\Delta} \tag{V}$$

$$\bar{S}_k^j = \frac{T_k^0|_{h_{exit}v_{exit}^{act}+\Delta} - T_k^0|_{v_{exit}v_{exit}^{act}}}{\Delta} \tag{VI}$$

In order to determine the sensitivities $S_{ki}^j$, $\tilde{S}_k^j$ and $\bar{S}_k^j$, the strip temperature model, in addition to the prediction of the temperature $T^j_k$, has to be solved once again. According to the Gauss-Newton method, the linearization (III) is inserted in the quadratic error of the target function (II). The following approximation is produced:

$$|T_k^j + \Delta T_k^j - T_k^d|^2 \approx \tag{VII}$$

$$|T_k^j - T_k^d|^2 + 2(T_k^j - T_k^d)\sum_{i=i_j}^{i_{kj}} S_{ki}^j \Delta u_i^j + 2(T_k^j - T_k^d)\tilde{S}_k^j \Delta a +$$

-continued $$2(T_k^j - T_k^d)\bar{S}_k^j \Delta s + 2\tilde{S}_k^j \Delta a \sum_{i=i_j}^{i_{kj}} S_{ki}^j \Delta u_i^j + 2\bar{S}_k^j \Delta s \sum_{i=i_j}^{i_{kj}} S_{ki}^j \Delta u_i^j +$$

$$2\bar{S}_k^j \tilde{S}_k^j \Delta s \Delta a + \sum_{i=i_j}^{i_{kj}} \sum_{i=i_j}^{i_{kj}} S_{ki}^j S_{ki}^j \Delta u_i^j \Delta u_i^j + |\tilde{S}_k^j|^2 |\Delta a|^2 + |\bar{S}_k^j|^2 |\Delta s|^2.$$

If the right-hand side of (VII) is now inserted in (II), then the quadratic programming problem presents itself in the following form:

$$\min = f + \underline{g}^t \underline{\chi} + \frac{1}{2}\underline{\chi}^t \underline{H} \underline{\chi} \tag{VIII}$$

$$\underline{b}^{lower} \leq \underline{\chi} \leq \underline{b}^{upper} \tag{IX}$$

Here f is a scalar, H a symmetrical, positive semi-definite N×N matrix which is positively definite when the positive parameters α, β and γ are chosen sufficiently large. The remaining variables are n-dimensional column vectors. The inequality (IX) is to be understood in component terms.

In order to solve the quadratic optimization problem, an active-set strategy is preferably used.

According to the invention, in particular travel diagrams for the rolling speed v and/or for the water ramps or coolant ramps of the inter-stand cooling (7) are particularly advantageously calculated and matched with especially high precision.

In addition to the advantages of the invention hereinabove and especially described in the introduction, the invention enables for the first time in the control and/or regulation of the temperature of a metal strip 6 in a simple manner a different weighting, in the sense of a prioritization, of the indications relevant for said control.

According to the invention, a flexible controlling and regulating method is provided which can also be used for other plant parts such as e.g. in particular the roughing train 2 or else the cooling stretch 4. A use of the invention covering more than one part of the plant 1 to 5 is possible. Use of the invention is particularly advantageous in dual-phase rolling and in the travel of a thickness wedge during the rolling of a semi-continuous slab.

The invention claimed is:

1. A method of controlling a temperature of strip metal processed in a finishing train of a technical installation, the method comprising:

comparing a target temperature gradient to an actual temperature gradient associated with the strip metal, the actual temperature gradient including a point temperature gradient determined for a number of individual local points of the strip metal;

determining a target function for at least one actuator having adjustment limitations, the actuator arranged in the finishing train, the target function determination based on the target temperature gradient, the actual temperature gradient, the adjustment limitations of the actuator, and the point temperature gradient for adjusting the actuator and controlling the temperature;

adjusting the actuator based on the target function so that the actuator is controlled via a control variable corresponding to a flow of cooling agent or a flow of material in order to control the temperature; and calculating adjusting signals for adjusting the actuator by solving an optimization problem represented by the target function and the side conditions.

2. The method according to claim 1, wherein the optimization problem includes linear side conditions.

3. The method according to claim 2, wherein the optimization problem is solved based on an active set strategy.

4. The method according to claim 2, wherein the optimization problem is a quadratic optimization problem.

5. The method according to claim 1, wherein the optimization problem is solved online.

6. The method according to claim 1, wherein at least one of the adjusting signals is used for controlling a flow of a cooling agent.

7. The method according to claim 1, wherein at least one of the adjusting signals is used for controlling a material flow of the strip metal through the finishing train.

8. The method according to claim 1, wherein the adjustment limitations of the actuator are used to enable a change of the control variable.

9. A method of controlling a temperature of strip metal processed in a finishing train of a technical installation, the method comprising:

comparing a target temperature gradient to an actual temperature gradient associated with the strip metal, the actual temperature gradient including a point temperature gradient determined for a number of individual local points of the strip metal;

determining a target function for at least one actuator having adjustment limitations, the actuator arranged in the finishing train, the target function determination based on the target temperature gradient, the actual temperature gradient, the adjustment limitations of the actuator, and the point temperature gradient for adjusting the actuator and controlling the temperature, adjusting the actuator based on the target function so that the actuator is controlled via a control variable corresponding to a flow of cooling agent or a flow of material in order to control the temperature; and pre-calculating an online-capable pass schedule algorithm using a non-linear optimization problem including further side conditions.

10. The method according to claim 9, wherein the further side conditions are substantially identical to the side conditions.

11. A method of controlling a temperature of strip metal processed in a finishing train of a technical installation, the method comprising:

comparing a target temperature gradient to an actual temperature gradient associated with the strip metal, the actual temperature gradient including a point temperature gradient determined for a number of individual local points of the strip metal;

determining a target function for at least one actuator having adjustment limitations, the actuator arranged in the finishing train, the target function determination based on the target temperature gradient, the actual temperature gradient, the adjustment limitations of the actuator, and the point temperature gradient for adjusting the actuator and controlling the temperature;

adjusting the actuator based on the target function so that the actuator is controlled via a control variable corresponding to a flow of cooling agent or a flow of material in order to control the temperature; and pre-calculating an online-capable pass schedule algorithm using a non-linear optimization problem including further side conditions.

* * * * *